US007252338B2

(12) United States Patent
Crossman

(10) Patent No.: US 7,252,338 B2
(45) Date of Patent: Aug. 7, 2007

(54) SEAT ASSEMBLY HAVING AN ADJUSTABLE HEIGHT AND ANGLE ARMREST

(75) Inventor: Mark W Crossman, Oakland Township, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 36 days.

(21) Appl. No.: 11/254,150

(22) Filed: Oct. 19, 2005

(65) Prior Publication Data

US 2007/0085403 A1 Apr. 19, 2007

(51) Int. Cl.
*A47C 7/54* (2006.01)

(52) U.S. Cl. ..... 297/411.33; 297/411.2; 297/411.3; 297/411.32; 297/411.36; 297/411.38

(58) Field of Classification Search ..... 297/411.2, 297/411.3, 411.32, 411.33, 411.35, 411.36, 297/411.37, 411.38
See application file for complete search history.

(56) References Cited

U.S. PATENT DOCUMENTS 5,374,102 A * 12/1994 Archambault et al. . 297/344.13
5,476,304 A * 12/1995 Gulliver et al. ..... 297/173
6,003,940 A * 12/1999 Jackson ..... 297/217.3
6,773,071 B1 * 8/2004 Stasney et al. ..... 297/411.27

* cited by examiner

*Primary Examiner*—Laurie K. Cranmer
(74) *Attorney, Agent, or Firm*—N. Sean Butler

(57) ABSTRACT

A seat assembly includes an armrest attached to a seat, and an amrest coupling assembly for coupling the armrest to the seat comprising a linear adjustment mechanism coupled to the armrest, and a rotational adjustment mechanism coupled to the armrest. The linear adjustment mechanism is arranged to enable the armrest to translate along an initial linear axis between a plurality of generally vertical positions. The rotational adjustment mechanism is arranged to enable the armrest to pivot about the rotational axis between a plurality of angular positions.

9 Claims, 4 Drawing Sheets

SEAT ASSEMBLY HAVING AN ADJUSTABLE HEIGHT AND ANGLE ARMREST

FIELD OF THE INVENTION

The present invention relates to a seat assembly for a motor vehicle and, more particularly, to seat assembly having an adjustable armrest.

BACKGROUND OF THE INVENTION

Seat assemblies for motor vehicles typically include armrests which are pivotally adjustable between a first, stored position in which the armrest is substantially parallel to the seat back and a second, deployed position in which the armrest is substantially parallel to the floor of the vehicle and may be used to support the arms of the passenger. However, known armrest assemblies are fixed about a single pivot which is not adjustable to accommodate vehicle occupants of differing heights. Furthermore, such armrest assemblies are typically angularly adjustable between only a first, stored position and a second, deployed position.

There exists a need for seat assembly having an armrest capable of both linear and angular adjustment through a plurality of selectable positions that is simple and inexpensive to assemble.

SUMMARY OF THE INVENTION

Accordingly, one aspect of the present invention provides a cost-effective seat assembly having an armrest capable of both linear and angular adjustment through a plurality of selectable positions, wherein the seat assembly includes an armrest attached to a seat, and an armrest coupling assembly for coupling the armrest to the seat comprising a linear adjustment mechanism coupled to the armrest and a rotational adjustment mechanism coupled to the armrest. The linear adjustment mechanism is arranged to enable the armrest to translate along an initial linear axis between a plurality of generally vertical positions. The rotational adjustment mechanism is arranged to enable the armrest to pivot about the rotational axis between a plurality of angular positions.

In accordance with a second aspect of the present invention, the rotational adjustment mechanism further comprises a first pivot formed between the armrest and the linear adjustment mechanism, and a second pivot formed between the linear adjustment mechanism and the seat, the second pivot arranged to enable the rotational adjustment mechanism to adjust angular orientation of the linear adjustment mechanism to define a plurality of subsequent linear axes.

In accordance with a third aspect of the present invention, a seat assembly for a vehicle is disclosed, the seat assembly comprising a seat, an armrest pivotally attached to the seat, and a disc positioned between the armrest and the seat. The disc defines a rotational axis and includes a plurality of disc slots spaced within the disc. A housing is pivotally attached to the disc, and positioned between the armrest and the disc. The housing defines an initial linear axis and includes a plurality of housing slots spaced within the housing. A pin is connected to the housing and arranged to enable the housing to pivot the disc about a rotational axis and engage one of the plurality of disc slots. A pin release mechanism is connected to the pin and arranged to enable the pin to disengage from one of the plurality of disc slots. A slider is positioned within the housing at a housing end and pivotally attached to the armrest at a connecting end, and arranged to translate within the housing along the initial linear axis and engage one of the plurality of housing slots. A slider release mechanism is connected to the slider and arranged to enable the slider to disengage from one of the plurality of housing slots.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
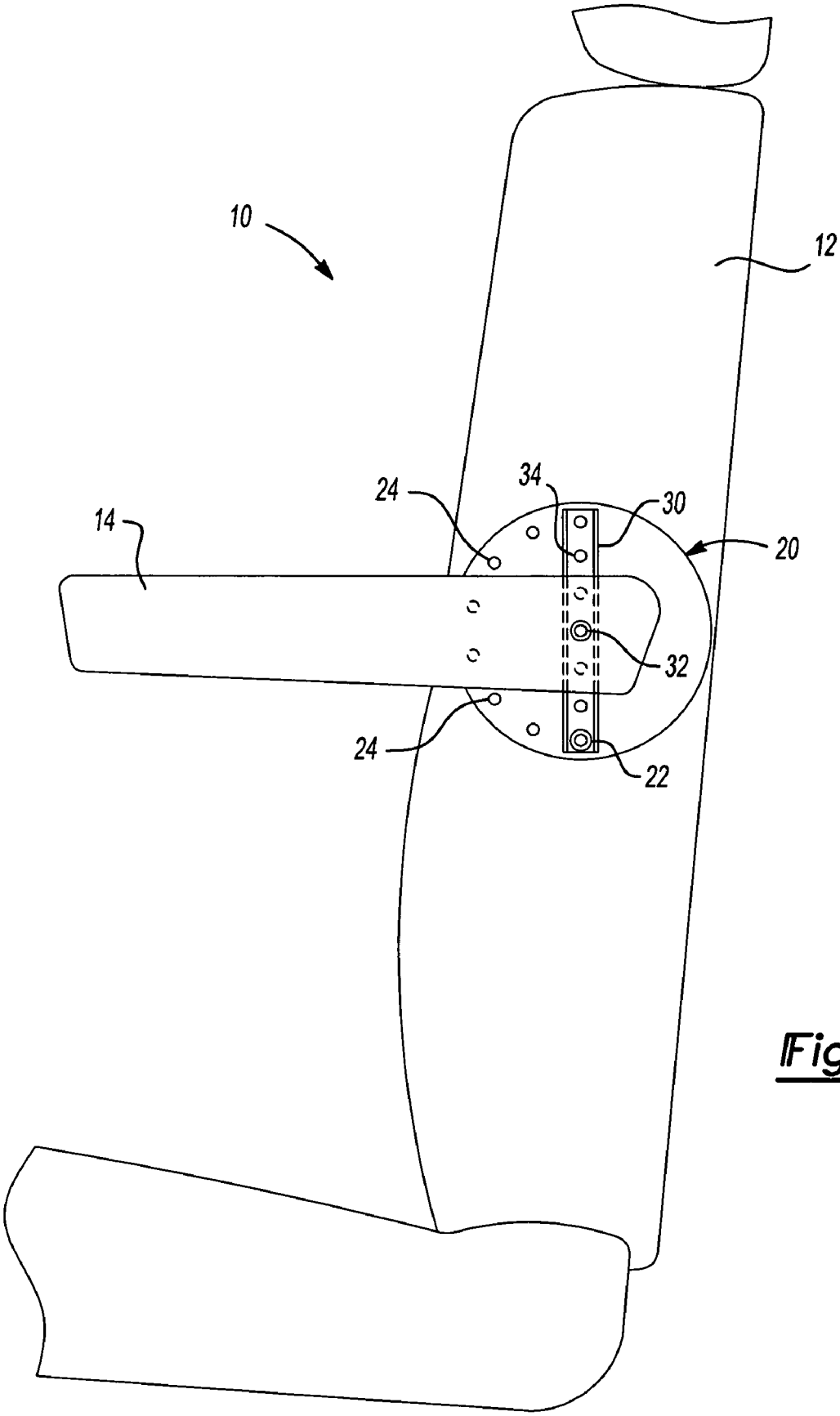
FIG. 1 shows a side view of a seat assembly according to an exemplary embodiment of the present invention.
Figure 2:
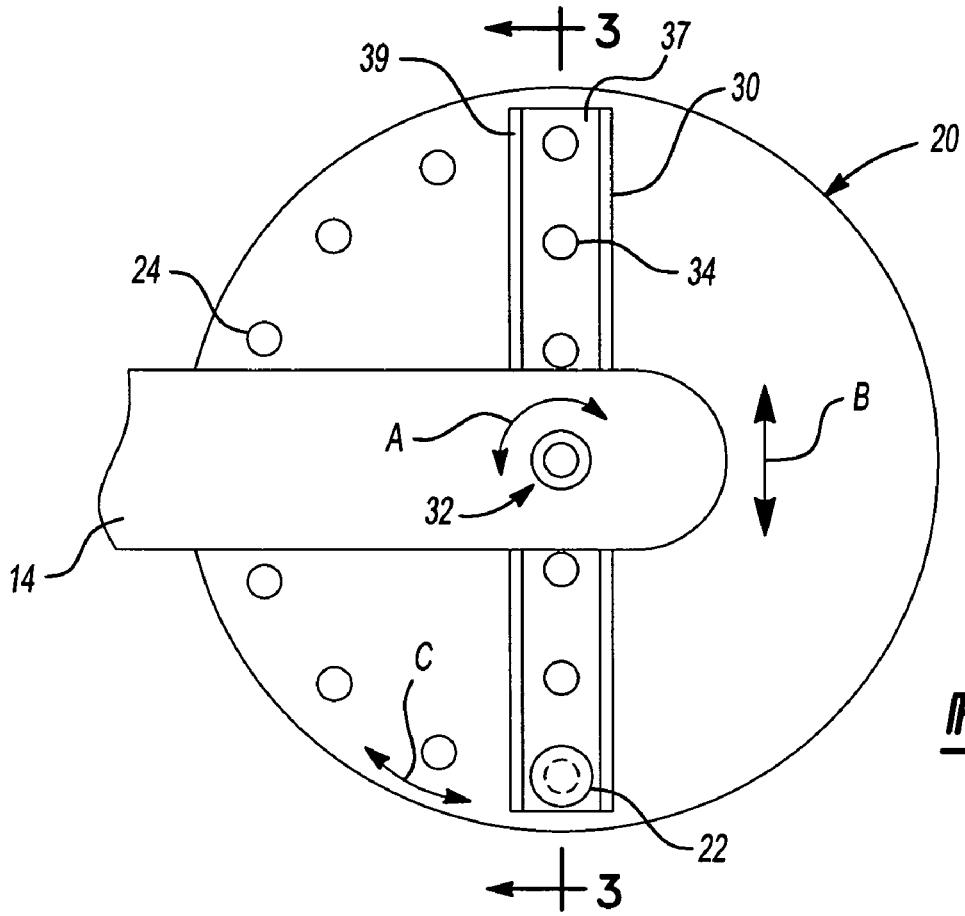
FIG. 2 shows a side view of the armrest and coupling arrangement of FIG. 1 in isolation.

Turning now to the drawings, particularly FIGS. 1 and 2, a vehicle seat 10 is shown having a seat back 12 and an armrest 14. According to a first exemplary embodiment of the present invention, the armrest 14 is movably engaged with a housing such as a bracket 30 through a slider assembly 32 connected to the armrest 14. The bracket 30 may further comprise an anchoring portion 37 having a generally straight cross section, and a pair of housing portions 39 having one of a generally "U" or "C"-shaped cross section for housing the slider assembly 32. The bracket 30 is pivotably mounted to a disc 20 by a fastener 31, such as a screw or bolt assembly, which is well known to those of ordinary skill in the art. As best illustrated in FIG. 3, a pin assembly 22 is arranged to engage both the bracket 30 and disc 20.

Armrest 14 may be adjusted relative to the seat back 12 in the direction of arrow A by pivoting the armrest about the slider assembly 32. For example, armrest 14 may be pivoted between a first, stored position in which the armrest is substantially parallel to the seat back, and a second, deployed position in which the armrest is substantially parallel to the floor.

Figure 6:
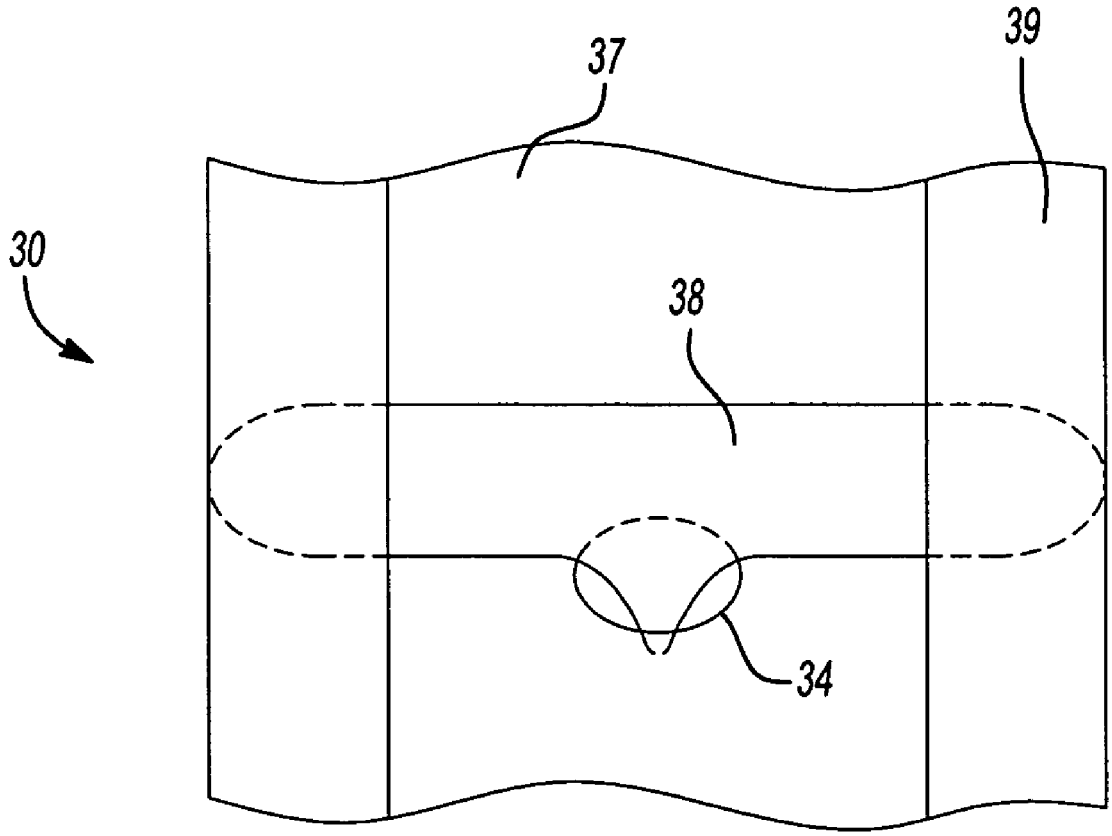
FIG. 6 shows a side view of a slider and housing assembly of FIG. 1 in isolation.

Referring to FIG. 6, slider assembly 32 is further comprised of a slider 38 and a slider release mechanism 36. Slider 38 is disposed within, and arranged to translate linearly within, the bracket 30, being enclosed by the housing portions 39. As shown in FIG. 2, the armrest 14 may also be translated linearly relative to the bracket 30, in the direction of arrow B by moving the armrest 14 and the slider assembly 32 within the bracket 30. The slider 38 may be used to lock the armrest 14 in place relative to the bracket 30 by engaging one of a plurality of bracket slots 34 disposed along bracket 30. As shown, the plurality of bracket slots 34 can be formed as a plurality of spaced holes arranged to receive the slider 38. The slider 38 includes a curved end to facilitate engagement with bracket slots 34. Slider 38 may then be disengaged from one of the plurality of bracket slots 34 by engaging slider release mechanism 36, thereby enabling the slider 38 to translate within the bracket 30.

Figure 3:
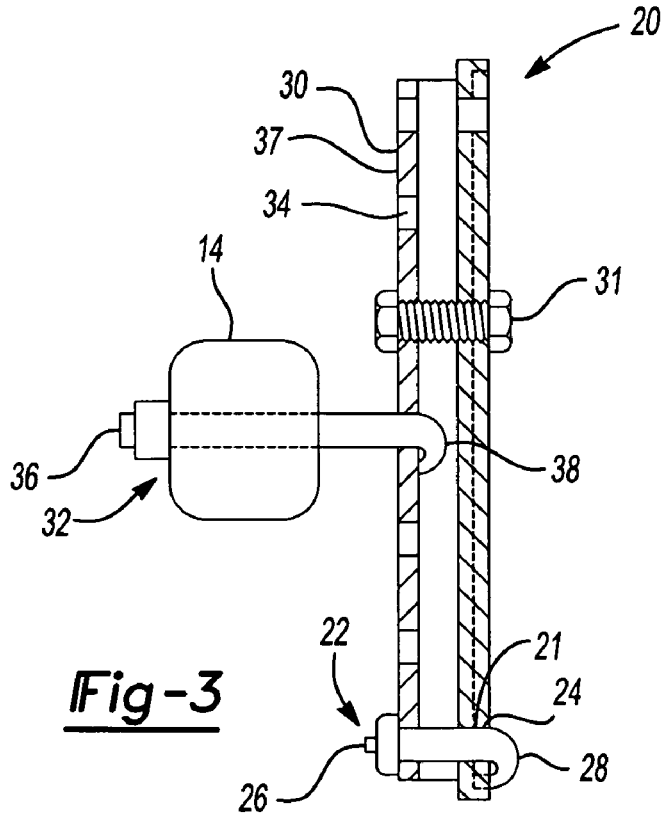
FIG. 3 shows a planar and sectional view of a seat assembly looking in the direction 3-3 shown in FIG. 2 according to a first exemplary embodiment of the present invention.
Figure 5:
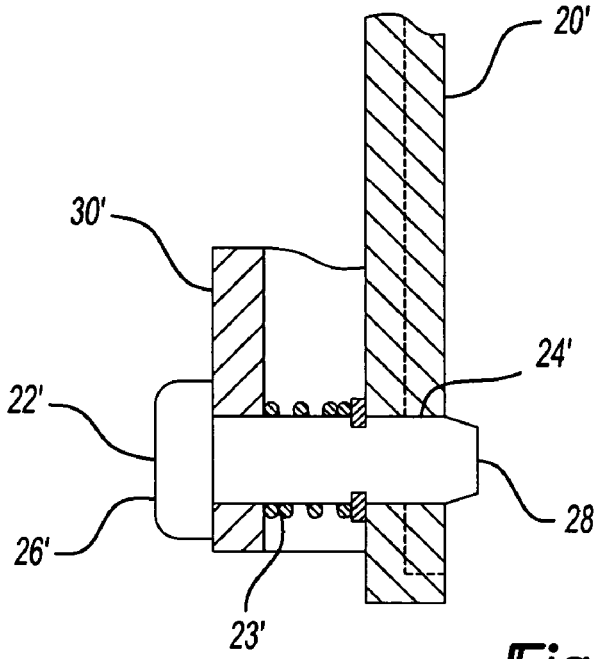
FIG. 5 shows a planar and section view of a seat assembly looking in the direction 3-3 as shown in FIG. 2 according to a second exemplary embodiment of the present invention.

According to a first exemplary embodiment, as best illustrated in FIG. 3, slider release mechanism 36 comprises a push button which may be biased, such as by a spring (not shown) toward the bracket 30 to disengage the slider 38 from one of the plurality of bracket slots 34 permitting the armrest 14 to be linearly translated within the bracket 30. According to a second exemplary embodiment, as best illustrated in FIG. 5, slider release mechanism 36 comprises a pull tab which may be biased away from bracket 30 to disengage the slider 38 from one of the plurality of housing slots 34 permitting the armrest 14 to be linearly translated within the bracket 30.

In further accordance with the present invention, the angular orientation of the armrest 14 relative to the seatback 12 may be separately adjusted by pivoting the bracket 30 about the disc 20 relative to the seat back 12 in the direction of arrow C. The rotation of the bracket 30 in the direction of arrow C also angularly adjusts the vertical and horizontal components of the linear axis of translation defined by the bracket 30.

Figure 4:
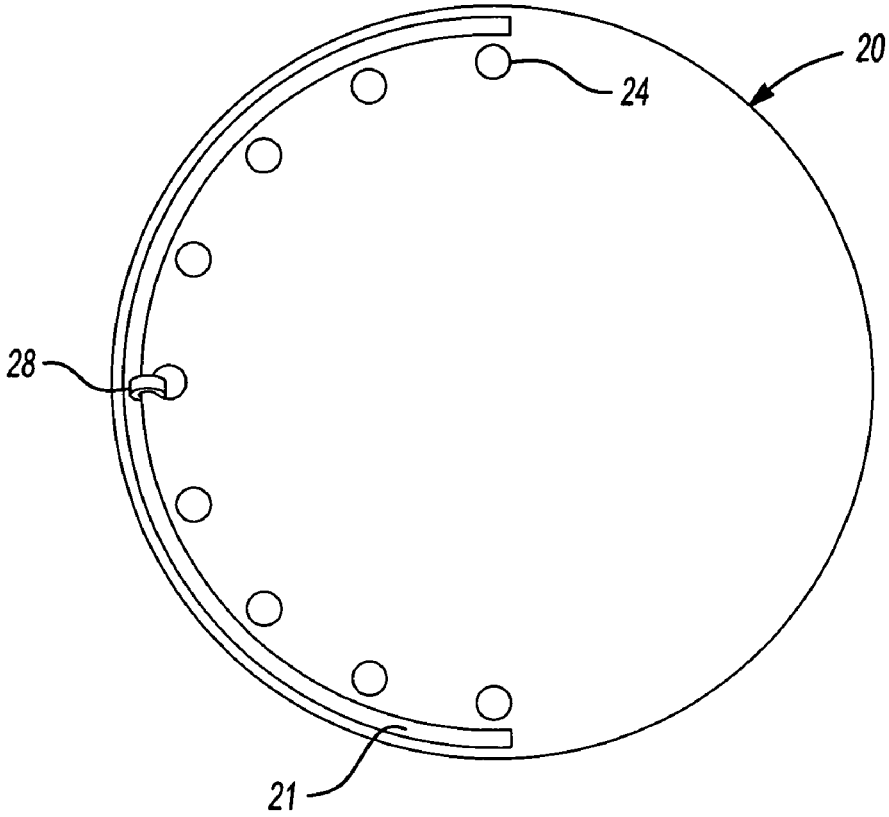
FIG. 4 shows a side view of a disc for a seat assembly according to an exemplary embodiment of the present invention.

Referring to FIG. 3, the pin assembly 22 further comprises a pin 28 and a pin release mechanism 26. The pin 28 is arranged to engage one of, as well as translate radially with respect to, a plurality of disc slots 24 disposed radially along the disc 20. The pin 28 may be used to lock the bracket 30 in place relative to the disc 20 by engaging one of a plurality of disc slots 24 disposed radially along the disc 20. The pin 28 includes a curved end to facilitate engagement with disc slots 24. As shown in FIGS. 2 and 4, the plurality of disc slots 24 can be formed as a plurality of spaced holes disposed along the perimeter of the disc 20. According to a second exemplary embodiment, disc slots 24 can be formed as a plurality of spaced indentations disposed along the perimeter of disc 20. The pin 28 may then be disengaged from one of the plurality of disc slots 24 by engaging pin release mechanism 26, thereby enabling the bracket 30 to be radially adjusted about a pivot 31 with respect to the disc 20.

As shown in FIGS. 3 and 4, the pin release mechanism 26 further includes a push button end which may be biased to disengage pin 28 from one of the plurality of disc slots 24, permitting the bracket 30 to rotate about pivot 31. Pin 28 may then be translated within channel 21 until the pin 28 is re-engaged in a different disc slot. Referring to FIG. 5, a second exemplary embodiment is shown, wherein the pin assembly 22' comprises a pull tab 26', a pin 28', and a plurality of disc slots 24'. Biasing pull tab 26' away from disc 20' disengages pin 28 from disc slot 24', thereby freeing bracket 30' to rotate about disc 20'. Spring mechanism 23' may bias pull tab 26' in the direction of disc 20' so as to assist in reengaging pin 28 with a disc slot 24'.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An armrest assembly for a seat comprising:

an armrest; and an armrest coupling assembly for coupling said armrest to said seat comprising:

a linear adjustment mechanism coupled to said armrest, said linear adjustment mechanism defining an initial linear axis and arranged to enable said armrest to selectively translate along said initial linear axis between a plurality of generally vertical positions;

said linear adjustment mechanism further comprising:

a housing attached to said seat, said housing helping define said linear axis and including a plurality of housing slots spaced within said housing;

a sliding mechanism positioned within said housing and connected to said armrest, said sliding mechanism further arranged to translate within said housing and engage one of said plurality of housing slots;

a release mechanism connected to said sliding mechanism, said release mechanism arranged to enable said sliding mechanism to disengage from one of said plurality of housing slots;

a rotational adjustment mechanism coupled to said armrest, said rotational adjustment mechanism defining a rotational axis and arranged to enable said armrest to selectively pivot about said rotational axis between a plurality of angular positions;

said rotational adjustment mechanism further comprising:

a first pivot formed between said armrest and said linear adjustment mechanism;

a second pivot formed between said linear adjustment mechanism and said seat, said second pivot arranged to enable said rotational adjustment mechanism to adjust angular orientation of said linear adjustment mechanism to define a plurality of subsequent linear axes;

each of said plurality of subsequent linear axes having a greater horizontal component than said initial linear axis a disc attached to said seat, said disc helping to define said rotational axis and including a plurality of disc slots spaced within said disc;

a pin connected to said linear adjustment mechanism, said pin arranged to pivot about said disc and engage one of said plurality of disc slots; and a pin release mechanism connected to said pin, said pin release mechanism arranged to enable said pin to disengage from one of said plurality of disc slots.

2. The armrest assembly of claim 1 wherein said plurality of disc slots further comprises a plurality of holes disposed along a perimeter of said disc.

3. The armrest assembly of claim 1 wherein said plurality of disc slots further comprises a plurality of indentations disposed along a perimeter of said disc.

4. The seat assembly of claim 1 wherein said disc further includes a channel disposed along a perimeter of said disc arranged to receive said pin.

5. The seat assembly of claim 1 wherein said pin release mechanism comprises a push button.

6. The seat assembly of claim 1 wherein said pin release mechanism comprises a pull tab.

7. A seat assembly for a vehicle comprising:

a seat an armrest; and an armrest coupling assembly for coupling said armrest to said seat comprising:

a linear adjustment mechanism coupled to said armrest, said linear adjustment mechanism defining an initial linear axis and arranged to enable said armrest to selectively translate along said initial linear axis between a plurality of generally vertical positions;

said linear adjustment mechanism further comprising:

a housing attached to said seat, said housing helping to define said linear axis and including a plurality of housing slots spaced within said housing;

a sliding mechanism positioned within said housing and connected to said armrest said sliding mechanism further arranged to translate within said housing and engage one of said plurality of housing slots;

a release mechanism connected to said sliding mechanism, said release mechanism arranged to enable said sliding mechanism to disengage from one of said plurality of housing slots;

said armrest further arranged to pivot relative to said sliding mechanism, said housing, and said seat;

said housing further comprising a bracket assembly, said bracket assembly further comprising:

an anchoring portion having a generally straight cross section for anchoring said bracket assembly to said seat;

at least one housing portion connected to said anchoring portion and having one of a generally "U" or "C"-shaped cross section wherein said sliding mechanism is contained within said housing portion;

a rotational adjustment mechanism coupled to said armrest, said rotational adjustment mechanism defining a rotational axis and arranged to enable said armrest to selectively pivot about said rotational axis between a plurality of angular positions;

said rotational adjustment mechanism further comprising:

a first pivot formed between said armrest and said linear adjustment mechanism;

a second pivot formed between said linear adjustment mechanism and said seat, said second pivot arranged to enable said rotational adjustment mechanism to adjust annular orientation of said linear adjustment mechanism to define, a plurality of subsequent linear axes.

8. The seat assembly of claim 7 wherein said plurality of linear position spaces further comprises a plurality of holes disposed along said anchoring portion of said housing.

9. The seat assembly of claim 7 wherein said rotational adjustment mechanism further comprises:

a disc attached to said seal, said disc helping to define said rotational axis and including a plurality of disc slots spaced within said disc;

a pin connected to said linear adjustment mechanism, said pin arranged to pivot about said disc and engage one of said plurality of disc slots; and a pin release mechanism connected to said pin, said pin release mechanism arranged to enable said pinto disengage from one of said plurality of disc slots.

* * * * *